United States Patent [19]

Laing

[11] 4,000,777

[45] Jan. 4, 1977

[54] ROTARY HEAT EXCHANGER

[76] Inventor: Nikolaus Laing, Hofener Weg 35-37, 7141 Aldingen near Stuttgart, Germany

[22] Filed: Sept. 10, 1974

[21] Appl. No.: 504,769

Related U.S. Application Data

[63] Continuation-in-part of Ser. No. 418,550, Nov. 23, 1973, abandoned.

[30] Foreign Application Priority Data

Nov. 23, 1972 Austria ..... 9968/72

[52] U.S. Cl. ..... 165/86; 62/499; 60/669

[51] Int. Cl.[2] ..... F28F 5/00; F22B 5/00; F25B 3/00

[58] Field of Search ..... 165/87, 90, 86; 62/499; 60/699, 657; 122/11

[56] References Cited

UNITED STATES PATENTS

| | | | |
|---|---|---|---|
| 1,628,391 | 5/1927 | Collingham | 122/11 |
| 2,811,841 | 11/1957 | Grimshaw | 62/499 |
| 2,991,979 | 7/1961 | Lincoln | 165/90 |
| 3,456,454 | 7/1969 | Kantor | 62/499 |
| 3,773,106 | 11/1963 | Levy | 165/86 |
| 3,850,147 | 11/1974 | Doerner | 60/669 |
| 3,863,454 | 2/1975 | Doerner | 60/669 |
| 3,866,668 | 2/1975 | Doerner | 165/92 |
| 3,911,694 | 10/1975 | Doerner | 60/669 |

*Primary Examiner*—Charles J. Myhre
*Assistant Examiner*—Theophil W. Streule, Jr.
*Attorney, Agent, or Firm*—Karl F. Ross; Herbert Dubno

[57] ABSTRACT

A heat exchanger for a thermodynamic machine, such as a heat pump or an expansion motor, comprises two corotating and coaxial sections, namely an evaporator section and a condenser section, interconnected by conduits in a closed circuit for the passage of a vaporizable working fluid. Each rotary section comprises an annular collector, centered on the axis of rotation, and an array of axially extending tubes closed at one end, the open tube ends being partly obstructed by barriers serving to retain a pool of liquefied working fluid by centrifugal force in an outer peripheral sector of each tube; the pool on the condenser side overflows into the corresponding collectors to form a reservoir for the liquid. A pump continuously delivers liquid working fluid from that reservoir to a set of injector pipes in the evaporator tubes at a mass-flow rate exceeding the mass-flow rate of the evolving vapors to maintain a steady supply of liquid in the evaporator tubes as well as an overflow which, after temporary storage in the evaporator collector, is recirculated to the injector pipes for reintroduction into the evaporator tubes together with fresh liquid from the condenser-side reservoir.

11 Claims, 5 Drawing Figures

ROTARY HEAT EXCHANGER

CROSS-REFERENCE TO RELATED APPLICATION

This application is a continuation-in-part of my copending application Ser. No. 418,550, filed November 23, 1973 and now abandoned.

FIELD OF THE INVENTION

My present invention relates to a rotary heat exchanger forming part of a thermodynamic machine, such as a heat pump or an expansion motor.

BACKGROUND OF THE INVENTION

Rotary heat exchangers with corotating, coaxial evaporator and condenser sections have been disclosed, for example, in my U.S. Pat. No. 3,811,495 and applications Ser. No. 234,433 filed March 13, 1972 (now Pat. No. 3,888,304), Ser. No. 286,569 filed Sept. 5, 1972 (now Pat. No. 3,877,515, and Ser. No. 383,537 filed July 30, 1973. In all these instances the two heat-exchanger sections are formed by tubes extending parallel to the axis of rotation in an annular array centered on that axis, these tubes being interconnected in a closed circuit containing a vaporizable working fluid. Circulation of the working fluid can be maintained by a pump and/or by centrifugal action.

If the thermodynamic machine operates as a heat pump, be it for heating or for cooling purposes, a compressor is inserted in the closed circuit downstream of the evaporator section and upstream of the condenser section to raise the temperature of the working fluid, allowing it to give off heat in the condenser section to a surrounding medium (which may be the ambient air) in order to be reliquefied; the compressor, of course, must be powered by an extraneous source. Conversely, if a thermal imbalance is maintained by extraneous means between the condenser section and the evaporator section, the vapors evolving in the latter section can be utilized to drive an expansion motor (e.g. a turbine) with resulting cooling effect. In either instance, conversion of mechanical energy to heat or vice versa occurs substantially adiabatically in the engine unit inserted between the two sections.

The advantage of a rotary evaporator of the aforedescribed type resides in the fact that the working fluid can be distributed in its tubes as a thin film in effective heat-exchanging relationship with the surrounding medium. In certain situations, however, too much working fluid may evaporate in this heat exchanger so that part of its tubes could run dry, thereby significantly impairing the efficiency of the operation; in some instances, especially where the evaporating heat-exchanger section is exposed to the flame of a burner, the local absence of working fluid may cause damage to the evaporator structure.

OBJECTS OF THE INVENTION

An object of my present invention, therefore, is to provide an improved rotary heat exchanger avoiding the aforestated drawbacks.

A more particular object is to provide heat exchanger of the general type disclosed in my above-identified U.S. patents and pending application having means for insuring the maintenance of an adequate but not excessive volume of vaporizable working fluid in the evaporator section thereof.

SUMMARY OF THE INVENTION

These objects are realized, pursuant to my present invention, by the provision of a reservoir for working-fluid condensate communicating with the condenser section of the heat exchanger via a first part of its conduit system and with the evaporator section thereof via a second part of that conduit system. With the aid of suitable circulation means, e.g. one or more piston-type or rotary pumps, the condensate is driven from the reservoir to the evaporator section at a mass-flow rate exceeding that of the evolving working-fluid vapors whereby excess condensate is retained in the evaporator which is equipped with storage means for that purpose. The evaporator section is further provided with return means for delivering an overflow of excess condensate, preferably continuously, from the storage means to the second part of the conduit system for recirculation to the evaporator section together with fresh condensate from the reservoir.

In an advantageous embodiment, both sections of the heat exchanger comprise annular collectors centered on its axis of rotation, each collector communicating with an array of tubes parallel to the axis. A set of perforated pipes, included in the aforementioned second part of the conduit system, extend axially into the evaporator tubes for injecting the condensate generally radially into same, these tubes having entrance ends partially obstructed by barriers located adjacent peripheral sectors thereof remote from the axis of rotation; sectoral tube portions bounded by these barriers serve as the storage means for the excess condensate. The collector on the condenser side serves as the reservoir whereas that on the evaporator side acts as a receptacle for condensate overflowing the barriers; the two collectors may be directly interlinked by a simple return connection or may jointly feed the injector pipes of the evaporator section, preferably with the aid of respective pumps discharging into a common header or manifold for these pipes.

Thus, another aspect of my invention resides in the a thermodynamic machine according to my invention may be operated by continuously delivering working-fluid condensate from reservoir to the evaporator section in a closed path, at the aforestated mass-flow rate exceeding that of vaporization, with interim storage of the returning condensate in liquid form in a portion of the evaporator section of the machine. In a preferred arrangement, this interim storage takes place in a peripheral tube sector remote from the axis of rotation, by virtue of the centrifugal force; advantageously, the relatively hot external medium interacting with the working fluid in this section impinges upon the tubes thereof from the opposite side, i.e. from the direction of the axis.

BRIEF DESCRIPTION OF THE DRAWING

The above and other features of my present invention will now be described in detail with reference to the accompanying drawing in which.

SPECIFIC DESCRIPTION

Figure 1:
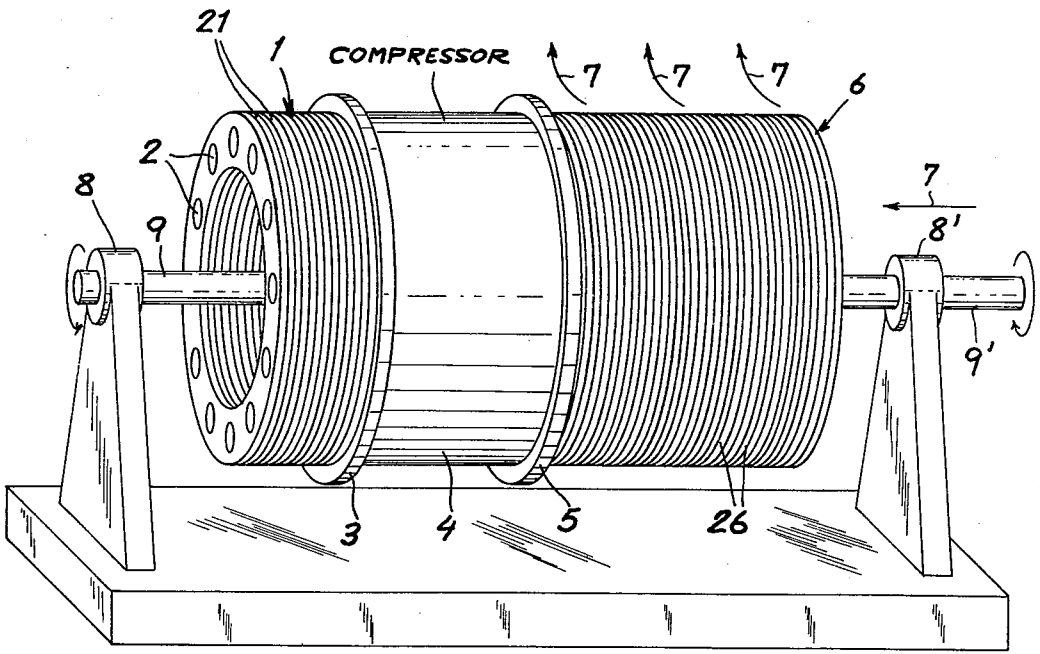
FIG. 1 is a perspective view illustrating, somewhat diagrammatically, a thermodynamic machine according to my invention.

In FIG. 1 I have shown a thermodynamic machine, here specifically a heat pump, comprising an evaporator section 1 and a condenser section 6 separated by an intermediate section 4 which is occupied by ancillary equipment, in this instance by a compressor. The compressor may be constructed, for example, along the lines disclosed in my prior U.S. Pat. No. 3,347,059, being driven through a magnetically pervious housing wall by an external rotating magnetic field so that the working fluid passing through the compressor remains hermetically sealed in the rotation unit 1, 4, 6 which is mounted on a pair of coaxial shafts 9, 9' journaled in bearings 8, 8'. The unit may be installed in a building wall, as described in U.S. Pat. No. 3,347,059, so that its evaporator section 1 is exposed to the outer atmosphere while its condenser section 6 is permeated by an airflow 7 circulating within a room to be heated. If the machine were to be used for cooling instead of heating, the arrangement would be reversed with evaporator section 1 located in the flow of room air and with condenser section 6 exposed to the outer atmosphere. Shaft 9 is rigid with the unit 1, 4, 6 which in turn is freely rotatable on the shaft 9' (as more fully illustrated in FIG. 2 described hereinafter), the two shafts being driven in opposite directions by a nonillustrated motor and transmission system. Shaft 9', which could also be held stationary, carries the external magnets preventing entrainment of the stator of the compressor inside section 4 by the associated rotor turning at the speed of shaft 9 (or vice versa).

The two coaxial heat-exchanger sections 1 and 6 are similarly constructed and consist each of a multiplicity of axially spaced annular fins traversed by an array of peripherally spaced, axially extending tubes, both of highly heat-conductive metal. In FIG. 1 only the tubes 2 of the evaporator section 1 can be seen, together with the associated fins 21, whereas of the condenser section 6 only the fins 26 are visible; the tubes 34 of the latter section have been shown in FIG. 2. The two sets of tubes 2, 34 communicate with respective annular collectors 3, 5 which, as seen in FIG. 2, form peripheral spaces 53, 39 partly occupied by pools of liquid working fluid 40, 40'.

Figure 2:
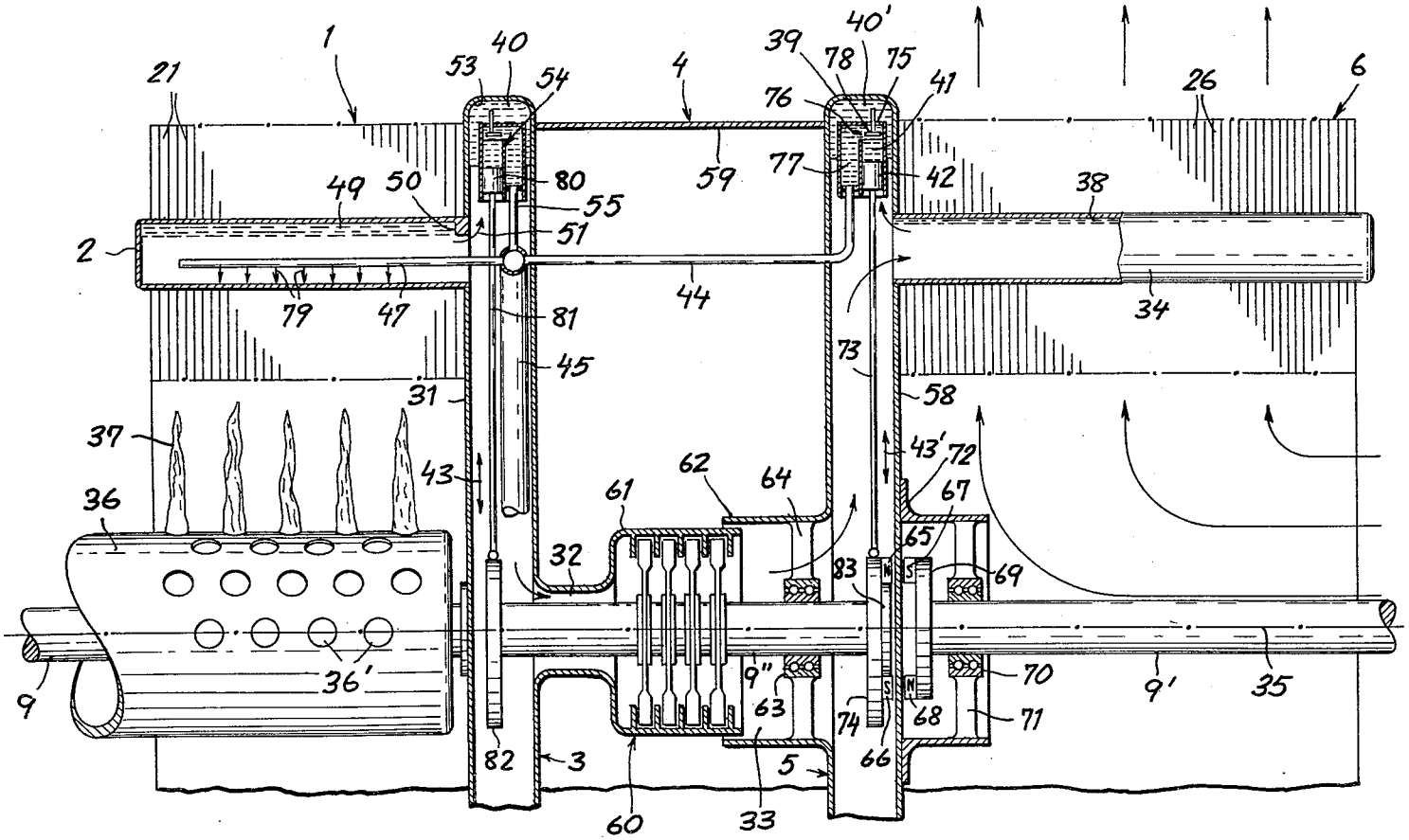
FIG. 2 is a longitudinal sectional view of a similar machine embodying my invention.

The outer sections 1 and 6 of the rotating heat-exchanger unit have the same construction in FIGS. 1 and 2. Whereas, however, the thermodynamic machine of FIG. 1 converts mechanical energy into a desired temperature differential, the machine of FIG. 2 has the opposite effect by changing heat into mechanical energy. Thus, shaft 9 is surrounded in FIG. 2 by a hollow gas pipe 36 acting as a burner, with flames 37 shooting out of perforations 36' of that pipe within evaporator section 1. Shaft 9 is rigid with an external wall 31 of collector 3 which, together with a similar wall 58 of collector 5, defines a sealed housing whose interior communicates with the closed-ended tubes 2 and 34. Within the peripheral wall 59 of intermediate section 4 there is disposed a thermo-mechanical energy converter in the form of a turbine 60 having a stator 61 rigid with the housing and a rotor 62 mounted on an intermediate shaft 9'' coaxial with shafts 9 and 9', the turbine 60 being centered on the same axis 35. The interior of stator 61 communicates with collector 3 through a relatively narrow inlet duct 32 for the vaporized working fluid which expands in the turbine and sets the stator 61 in rotation with reference to rotor 62; the terms "rotor" and "stator" are of course to be understood in a relative sense. The expanded working fluid enters the collector 5 through a larger duct 33 within which a journal bearing 63 for the intermediate shaft 9'' is mounted on stays 64. Shaft 9'' terminates in a cross-bar 83 adjacent housing wall 58 which is pervious to magnetic flux and has substantially unity magnetic permeability, bar 83 carrying at least one pair of permanent magnets 65, 66 which coact with similar magnets 67, 68 on a cross-bar 69 at the confronting end of shaft 9''. The journal bearing 70 for the latter shaft is held by stays 71 in a collar 72 externally secured to housing wall 58.

With the unit 1, 4, 6 thus set in rotation about axis 35, the expanded working fluid is centrifugally directed from duct 33 toward the periphery of collector 5 where it enters the condenser tubes 34; the temperature of the fluid at this stage may be only slightly above its boiling point which should be higher than ambient temperature whereby, through the heat-exchanging effect of the thermally conductive tubes 34, the fluid in these tubes is liquefied to form a condensate film 38 which overflows into the space 39 of collector 5, resulting in the pool of condensate 40' within that collector. The quantity of working fluid within the sealed housing is sufficient to insure the presence of that pool throughout the operation of the machine.

A pump 41 has a cylinder within which a piston 42 is radially reciprocable (arrow 43'), this piston being mounted on a rod 73 whose opposite end constitutes a cam follower riding on a cam disk 74 secured to shaft 9''. The piston cylinder of pump 41 has an intake port 75, immersed in the pool 40', and a discharge port 76 opening into a pump chamber 77, the two ports being controlled by a valve 78 responsive to the piston stroke. A conduit 44 extends from pump chamber 77 to an annular manifold 45 in collector 3, this manifold in turn communicating with a multiplicity of injector pipes 47 entering axially into respective tubes 2 of evaporator section 1. Pipes 47 have perforations facing the axis 35 for the discharge of the oncoming condensate into these tubes, as indicated by arrows 79. Since the tubes 2 are heated on the axis side by the flames 37 of burner 36, a part of this condensate is vaporized and passes inwardly toward central duct 32 to drive the turbine 60. The delivery rate of pump 41, however, is higher than the evaporation rate so that a portion of the oncoming condensate shielded from the flames 37 remains liquid and accumulates in a storage space 49 remote from axis 35 bounded by a segmental barrier or weir 50 at the entrance end of each tube, an overflow of the stored liquid reaching the radially outwardly located receptacle 53 in collector 3 by centrifugal action to form the pool 40 as indicated by arrow 51.

Figure 3:
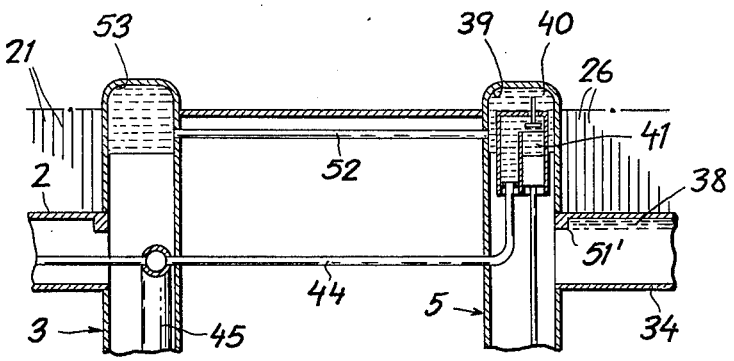
FIG. 3 is a fragmentary sectional view similar to part of FIG. 2, showing a modification.

In the system of FIG. 2 the collector 3 accommodates a second pump 54, generally similar to pump 41, whose piston 80 is mounted on a rod 81 coacting with another cam disk 82 on shaft 9'' so as to be reciprocated at least once per revolution, in the same manner as piston 42, as indicated by arrow 43. Pump 54 returns the overflowing liquid from pool 40 via a conduit 55 to manifold 45 where it combines with fresh condensate from conduit 44 recirculated to injector pipes 47. As shown in FIG. 3, however, the pump 54 could be omitted with return of the overflow condensate to the pool 40' in reservoir 39 by way of an axially extending conduit 52 interconnecting the two collectors 3 and 5; this simplification is achieved at the expense of a certain reduction in pumping efficiency since the recirculated condensate must pass through the conduit 44 which in the system of FIG. 2 is bypassed by the second pump 54 and its discharge port 55 downstream of the outlet of pump 41.

Figure 4:
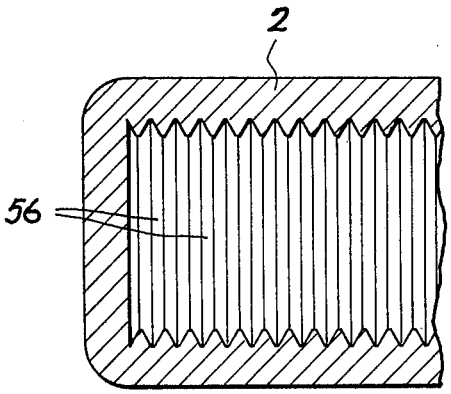
FIG. 4 is an enlarged axial sectional view of the closed end of an evaporator tube in a machine as shown in FIG. 1 or 2.
Figure 5:
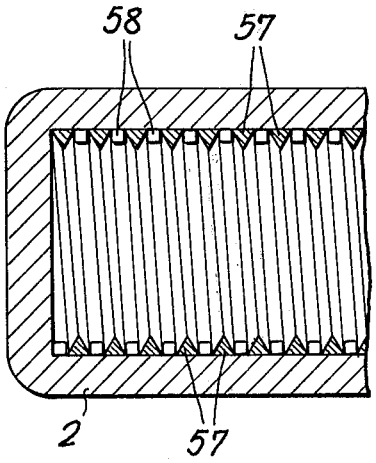
FIG. 5 is a view similar to FIG. 4, illustrating a modification.

In order to help retain the excess condensate in the evaporator tubes 2, I prefer to roughen or corrugate the internal surfaces of these tubes so as to increase their surface-tension effect. This can be achieved, as shown in FIG. 4, by machining these inner surfaces to form a set of fine peripheral grooves 56 thereon; the walls of the grooves then exert a capillary attraction upon the liquid working fluid. Instead of a multiplicity of parallel grooves 56, a single helical groove can be used; such a helical groove can be formed, for example, with the aid of a very thin metal strip 57 of triangular profile helically coiled inside the tube, as illustrated in FIG. 5. The turns of the coiled strip 57 can be positively held in position by axially spaced bosses 58 rigid with the tube wall.

If desired, weirs similar to barriers 50 could also be provided at the entrance ends of condenser tubes 34 to insure the maintenance of a certain depth of liquid film 38 therein.

I claim:

1. In a heat exchanger for a thermodynamic machine, comprising a rotary unit with an evaporator section, a condenser section and conduit means establishing a closed circuit for the passage of a working fluid in a vaporized state from said evaporator section via a thermo-mechanical energy converter to said condenser section and in a liquefied state from said condenser section to said evaporator section, said evaporator section including an array of tubes parallel to the axis of rotation of said unit, the improvement wherein said rotary unit further includes:

an annular collector centered on said axis, said collector forming a receptacle disposed radially outwardly of said array of tubes;

a reservoir for working-fluid condensate communicating via a first part of said conduit means with said condenser section, a second part of said conduit means extending from said reservoir to said tubes;

circulation means in said conduit means for driving condensate from said reservoir into said tubes at a mass-flow rate exceeding the mass-flow rate of the evolving working-fluid vapors, said tubes having entrance ends partially obstructed by barriers located adjacent peripheral sectors thereof remote from said axis, said barriers defining storage areas for centrifugally retaining excess condensate, said collector communicating with said entrance ends for receiving an overflow of said excess condensate from said storage areas and transmitting said overflow to said receptacle by centrifugal action; and return means for delivering said overflow from said receptacle to said second part of said conduit means for recirculation to said tubes together with fresh condensate from said condenser section.

2. The improvement defined in claim 1 wherein said second part of said conduit means comprises a set of perforated pipes extending axially into said tubes for injecting said condensate generally radially into same.

3. The improvement defined in claim 2 wherein said circulation means comprises a first pump having a first intake port connected to said reservoir and a first discharge port connected to said pipes, said return means including a second pump having a second intake port connected to said receptacle and a second discharge port connected to said pipes downstream of said first discharge port.

4. The improvement defined in claim 2 wherein said return means comprises a connection from said receptacle to said reservoir, said circulation means comprising a pump having an intake port connected to said reservoir and a discharge port connected to said pipes.

5. The improvement defined in claim 2 wherein said condenser section is coaxial with said evaporator section and includes another annular collector, centered on said axis of rotation, and another array of tubes parallel to said axis communicating with said other collector, said reservoir being part of said other collector.

6. The improvement defined in claim 5 wherein said circulation means comprises a pump mounted in said other collector.

7. The improvement defined in claim 2 wherein said tubes have finely annulualy corrugated inner wall surfaces.

8. The improvement defined in claim 7 wherein said inner wall surfaces are formed by coiled metallic elements.

9. In a heat exchanger for a thermodynamic machine, comprising a rotary unit with an evaporator section, a condenser section and conduit means establishing a closed circuit for the passage of a working fluid in a vaporized state from said evaporator section via a turbine to said condenser section and in a liquefied state from said condenser section to said evaporator section, said evaporator section including an array of tubes parallel to the axis of rotation of said unit, the improvement wherein said rotary unit further includes:

an annular collector centered on said axis, said collector forming a receptacle disposed radially outwardly of said array of tubes;

a reservoir for working-fluid condensate communicating via a first part of said conduit means with said condenser section, a second part of said conduit means extending from said reservoir to said tubes;

heating means for vaporizing working-fluid condensate fed via said second part of said conduit means into said tubes;

circulation means in said conduit means for driving condensate from said reservoir into said tubes at a mass-flow rate exceeding the mass-flow rate of the evolving working-fluid vapors, said tubes having storage areas shielded from said heating means for retaining excess condensate, said collector communicating with said tubes for receiving an overflow of said excess condensate from said storage areas and transmitting said overflow to said receptacle by centrifugal action; and return means for delivering said overflow from said receptacle to said second part of said conduit means for recirculation to said tubes together with fresh condensate from said condenser section.

10. The improvement defined in claim 9 wherein said heating means is disposed in the vicinity of said axis.

11. The improvement defined in claim 10 wherein said tubes have entrance ends partially obstructed by barriers located adjacent peripheral sectors thereof remote from said axis, said storage areas being bounded by said barriers.

* * * * *